United States Patent [19]

Barsin et al.

[11] 4,144,017

[45] Mar. 13, 1979

[54] PULVERIZED COAL COMBUSTOR

[75] Inventors: Joseph A. Barsin; David M. Marshall; Edward A. Pirsh, all of Akron, Ohio

[73] Assignee: The Babcock & Wilcox Company, New York, N.Y.

[21] Appl. No.: 741,902

[22] Filed: Nov. 15, 1976

[51] Int. Cl.[2] ..... F23L 9/00

[52] U.S. Cl. ..... 431/10; 431/160; 431/165; 431/174; 431/351

[58] Field of Search ..... 431/10, 160, 164, 165, 431/174, 175, 351, 352, 353, 8; 60/39, 65, DIG. 11

[56] References Cited

U.S. PATENT DOCUMENTS

| | | | |
|---|---|---|---|
| 1,867,221 | 7/1932 | Hepburn | 431/175 X |
| 2,275,394 | 3/1942 | Hardgrove | 110/28 E |
| 3,048,131 | 8/1962 | Hardgrove | 431/10 X |
| 3,730,668 | 5/1973 | Iida et al. | 431/10 |
| 3,856,455 | 12/1974 | Otway et al. | 431/10 X |
| 3,868,211 | 2/1975 | Lahaye et al. | 431/115 X |
| 3,890,084 | 6/1975 | Voorheis et al. | 431/10 |
| 4,013,399 | 3/1977 | Craig et al. | 431/351 |
| 4,021,186 | 5/1977 | Tenner | 431/10 |
| 4,021,188 | 5/1977 | Yamigishi et al. | 431/10 |
| 4,060,376 | 11/1977 | Peredi | 431/10 X |
| 4,060,378 | 11/1977 | Peredi | 431/10 X |

*Primary Examiner*—Edward G. Favors

*Attorney, Agent, or Firm*—J. Maguire; R. J. Edwards

[57] ABSTRACT

An apparatus and method whereby fuel is burned in serially connected furnaces under controlled combustion temperature and airflow conditions so as to inhibit the formation of nitric oxides while achieving complete combustion of the fuel.

7 Claims, 9 Drawing Figures

FIG. 1
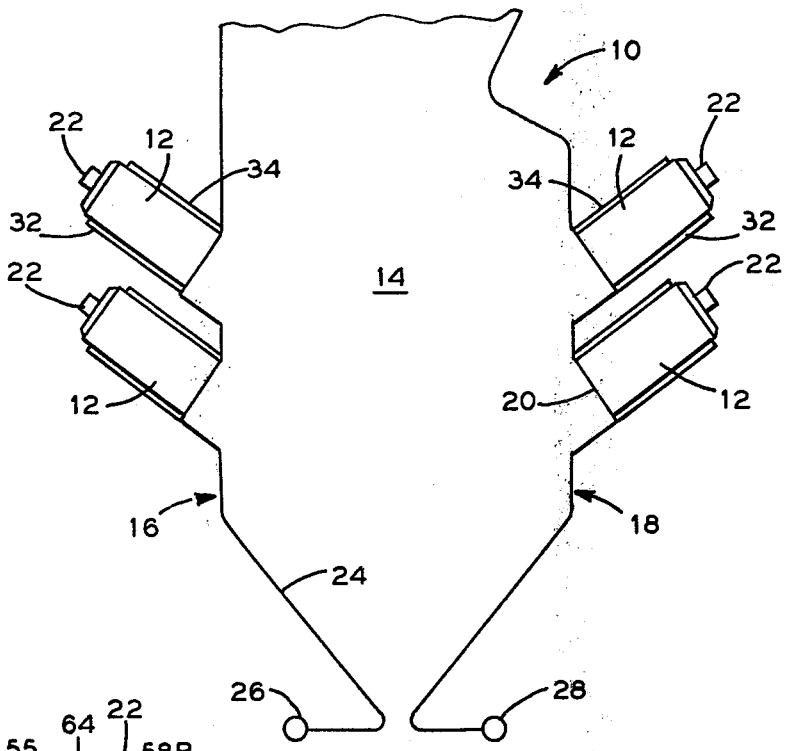
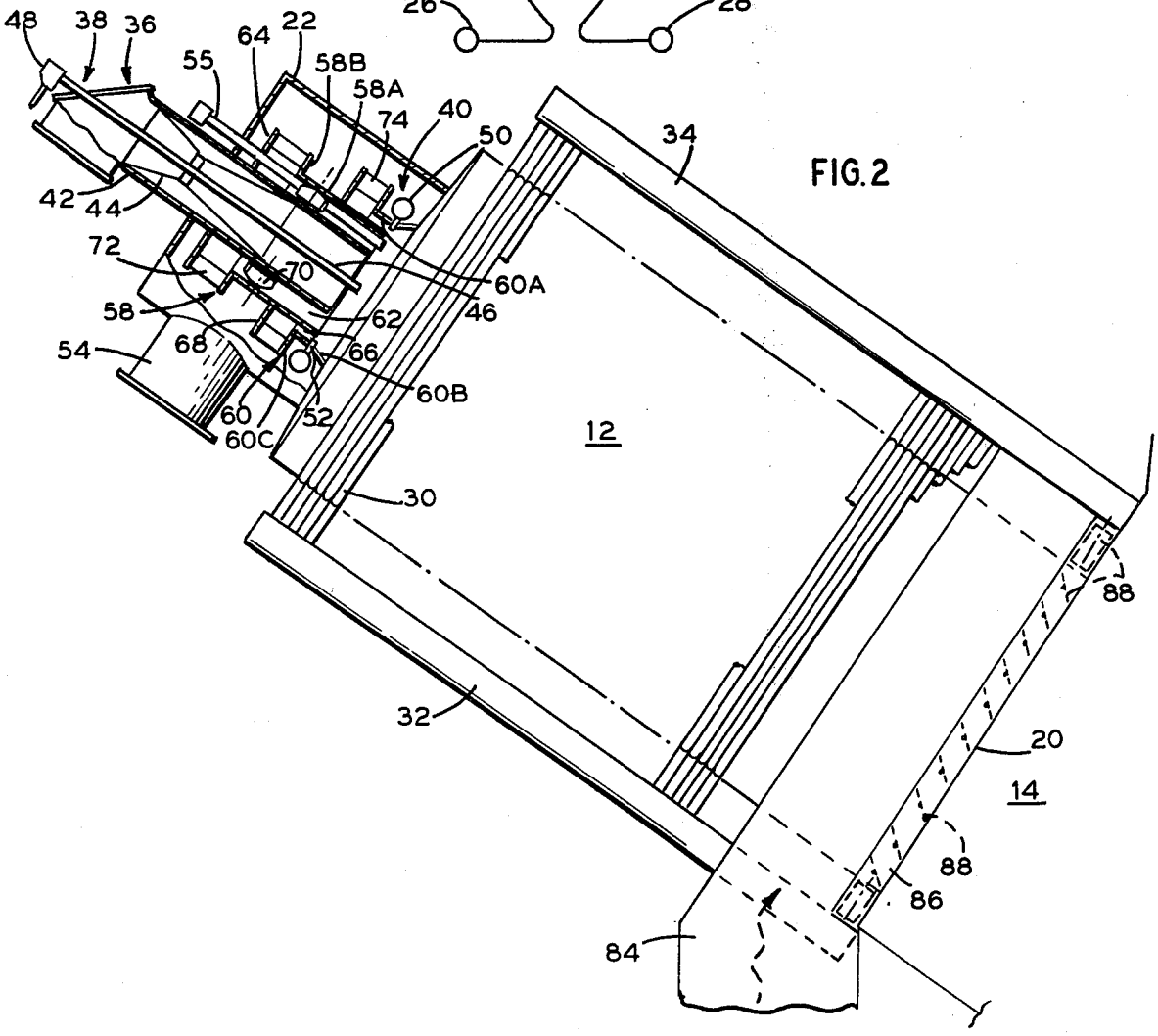
FIG. 2

FIG. 3
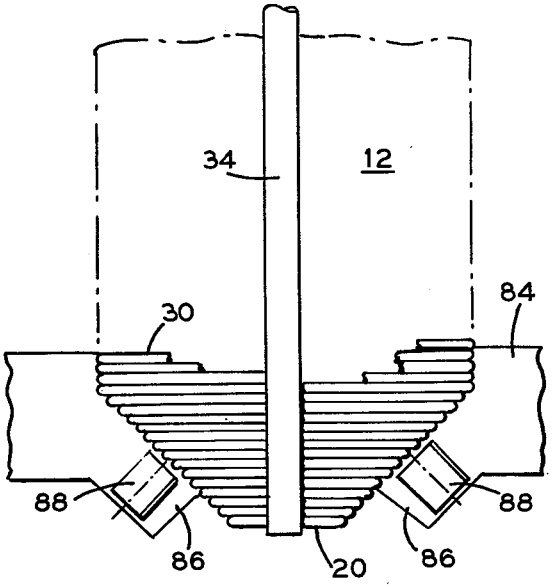
FIG. 4
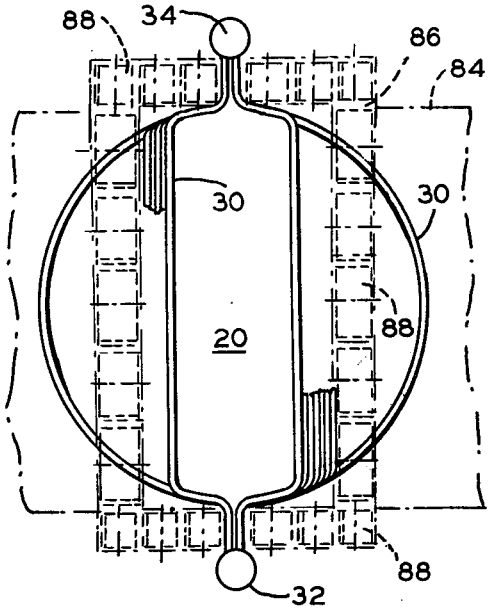
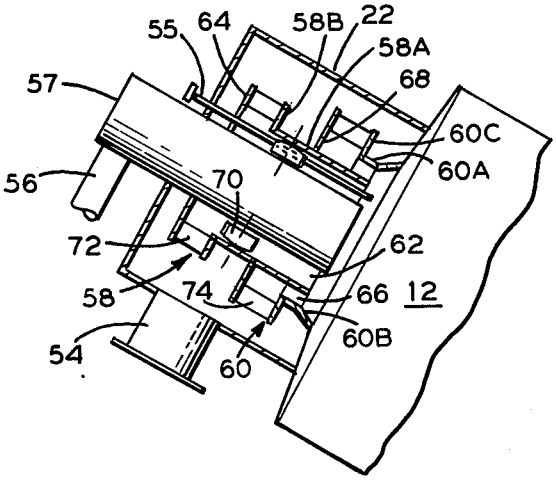
FIG. 5
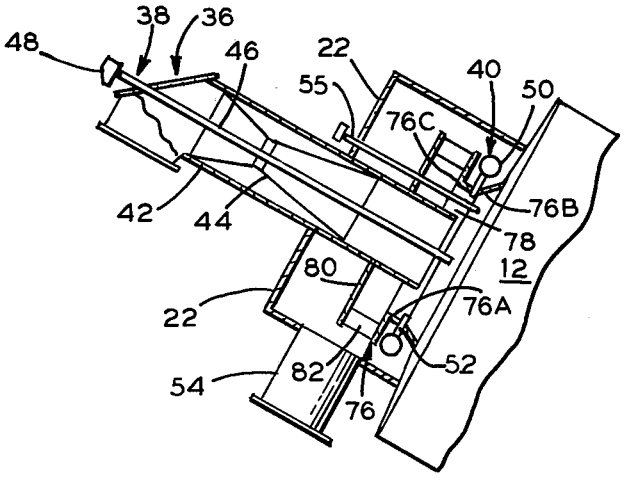
FIG. 6

PULVERIZED COAL COMBUSTOR

BACKGROUND OF THE INVENTION

The present invention relates to fuel firing and more particularly to an arrangement for reducing the formation of nitric oxides.

There is a present day growing concern with the immediate and long term problems created by the rapid increase in air pollution resulting from a rise in the industrial civilization level throughout the world. With this concern comes an acute awareness that immediate steps must be taken to reverse this upward trend in pollution and great efforts are now being made by public and private economic sectors to develop measures for preventing potentially polluting particles and gases from being discharged into the atmosphere. One such source of atmospheric pollution is the nitrogen oxides ($NO_x$) present in the stack emission of fossil fuel fired steam generating units. Nitric oxide (NO) is an invisible, relatively harmless gas. However, after it is discharged from the stack and comes into contact with oxygen, it reacts to form nitrogen dioxide ($NO_2$) or other oxides of nitrogen collectively referred to as nitric oxides. Nitrogen dioxide is a yellow-brown gas which, in sufficient concentrations is toxic to animal and plant life. It is this gas which may create the visible haze at the stack discharge of a vapor generator.

With the advent of stricter emission controls, manufacurers of fuel burning equipment have been actively seeking techniques for limiting the amount of pollutants which are formed from the combustion of fossil fuel. Such techniques are disclosed in U.S. Pat. Nos. 3,788,796; 3,880,570 and 3,904,349 assigned to the Assignee of the present invention.

Nitric oxide is formed as a result of the reaction of nitrogen and oxygen and may be fuel derived nitric oxide and/or thermal nitric oxide. The former occurs from the reaction of the nitrogen contained in the fuel with the oxygen in the combustion air whereas the latter results from the reaction of the nitrogen and oxygen contained in the combustion air.

The rate at which fuel nitric oxide is formed is principally dependent on the oxygen supply in the ignition zone. No appreciable nitric oxide is produced under a reducing atmosphere; that is, a condition where the level of oxygen in the ignition zone is below that required for a complete burning of the fuel. Under these conditions, the fuel nitrogen compounds are decomposed and will not produce nitric oxide in further stages of air supply within regulated temperature levels.

The rate at which thermal nitric oxide is formed is dependent upon any or a combination of the following variables; (1) flame temperature, (2) residence time of the combustion gases in the high temperature zone and (3) excess oxygen supply. The rate of formation of nitric oxide increases as flame temperature increases. In vapor generators of the type hereunder discussion wherein the combustion of fuel and air may generate flame temperatures in the order of 3,700° F., the time-temperature relationship governing the reaction is such that at flame temperature at or below 2,900° F. no appreciable nitric oxide (NO) is produced, whereas above 2,900° F. the rate of reaction increases rapidly.

Thus, one will recognize from the foregoing discussion that the formation of nitric oxide from fuel nitrogen is inhibited by maintaining a reducing atmosphere, and the formation of nitric oxide from air nitrogen is inhibited by maintaining flame temperature at or below 2,900° F.

SUMMARY OF THE INVENTION

The present invention sets forth an apparatus and method whereby fuel is burned in serially connected furnaces under controlled combustion temperature and airflow conditions to achieve a greater reduction in the formation of nitric oxide than has heretofore been possible.

Accordingly, there is provided at least one fluid cooled primary furnace and a fluid cooled secondary furnace. The primary furnace is formed with opposed inlet and outlet openings, the inlet opening communicating with a plenum chamber and the outlet opening communicating with the secondary furnace. The plenum chamber admits fuel, combustion gas and air to the primary furnace. Diverse fuels are injected into the primary furnace through any one or a combination of burners. A common duct conveys the combustion gas and air to the plenum chamber for delivery to the primary furnace. A second duct delivers combustion air to the secondary furnace at a location adjacent to the primary furnace outlet. In an embodiment of the invention, the combustion gas and at least some of the combustion air delivered to the primary furnace is separated into controlled first and second streams wherein the first stream surrounds the second stream.

The present invention includes a method whereby the combustion air delivered to the primary furnace is regulated to introduce 50 to 70 percent of total stoichiometric air to the primary furnace while maintaining the maximum combustion temperature at or below 2500° F. The combustion air delivered to the secondary furnace is regulated to introduce 50 to 70 percent of total stoichiometric air to the secondary furnace while maintaining combustion temperature at or below 2900° F. The total quantity of combustion air supplied to both the primary and secondary furnaces is maintained in the range of 105 to 125 percent of total stoichiometric air. Recirculated combustion gas may be delivered to the primary furnace to help maintain primary and secondary furnace maximum combustion temperature at or below the prescribed limits. During the firing of air-conveyed pulverized coal, the conveying air comprises 15 to 30 percent ot total stoichiometric air. In the embodiment which separates the combustion gas and air delivered to the primary furnace into first and second streams, the first stream is regulated to provide approximately 60 to 70 percent of the separated combustion gas and air with the remainder going to the second stream.

BRIEF DESCRIPTION OF THE DRAWINGS

FIG. 1 is a schematic sectional elevation view of a vapor generator embodying the invention.

FIG. 2 is a sectional elevation view of the primary furnace associated with a dual register burner adapted to fire coal and/or oil and/or natural gas.

FIG. 3 is a top view of the primary furnace.

FIG. 4 is a rear end view of the primary furnace.

FIG. 5 is a partial view of the primary furnace associated with a dual register burner adapted to fire synthetic or low B.T.U. gas.

FIG. 6 is a partial view of the primary furnace associated with single register burner adapted to fire coal and/or oil and/or natural gas.

DESCRIPTION OF THE PREFERRED EMBODIMENTS

Figure 9:
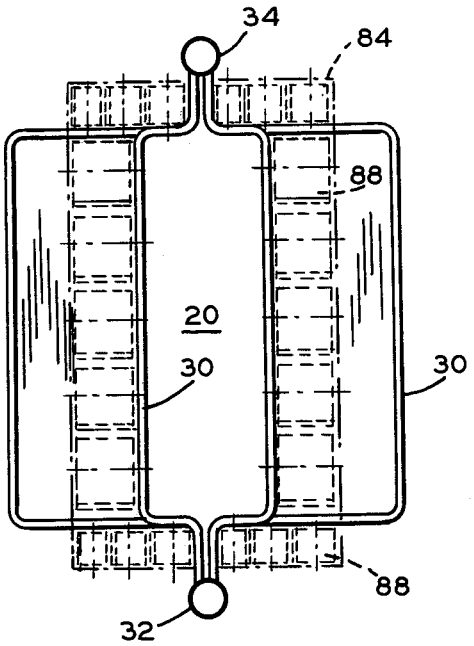
FIG. 9 is a rear end view of an alternate embodiment of the primary furnace.

Referring to FIGS. 1 and 2, there is shown a vapor generator 10 including fluid cooled walls which define a plurality of primary furnaces 12 of circular cross-section and a secondary furnace 14 of rectangular cross section. The front and rear walls 16 and 18 of the secondary furnace 14 have portions thereof accommodating the downwardly sloped primary furnaces 12 whose respective outlets 20 discharge into the secondary furnaces 14. A plenum chamber 22 is provided at the front end of the primary furnaces 12. Fluid is supplied to the tubes 24 of the front and rear walls 16 and 18 through the lower headers 26 and 28, and to the tubes 30 of the primary furnaces 12 through the lower headers 32. The primary furnace tubes 30 are connected for discharge of fluid to the upper headers 34. The outside surfaces of the primary and secondary furnaces 12 and 14 are covered with insulation and sheet metal casing. The fire side of the secondary furnace 14 is generally bare as is that of the primary furnaces 12 equipped for only gas and oil firing. Primary furnaces 12 equipped for coal firing will normally have the fire side studded and covered by a layer of refractory material.

Referring to FIGS. 2 and 6, there is shown a primary furnace 12 equipped with a pulverized coal burner 36, an oil burner 38 and a natural gas burner 40. Each of the burners is adapted so that it can be fired alone or in combination with one or both of the other burners. The coal burner 36 includes a discharge nozzle 42 fitted with a venturi section 44. The oil burner 38 includes a barrel section 46 having its inlet end fitted to a yoke assembly 48. The gas burner includes a ring-shaped inlet manifold 50 formed with nozzles 52 discharging into the inlet of the primary furnace 12. A common duct 54 delivers combustion air and recirculated combustion gas to the plenum chamber 22 for discharge to the primary furnace 12. An ignition device 55 is provided to light the fuel or fuels being injected into the primary furnace 12.

Referring to FIG. 5, there is shown a primary furnace 12 equipped with a synthetic or low B.T.U. gas burner which includes a discharge nozzle 57 receiving fuel from a supply pipe 56. The duct 54 delivers combustion air and recirculated combustion gas to the plenum chamber 22. Lighting of the fuel is effectuated with the ignition device 55.

Referring to FIGS. 2 and 5, the burner assemblies shown therein are equipped with dual air registers. Each dual air register is comprised of sleeve members 58 and 60 disposed within the plenum chamber 22 to discharge combustion air and recirculated combustion gas to the inlet of the primary furnace 12. The sleeve member 60 has a portion thereof 60A concentrically spaced about the portion 58A to form a first annular passageway 66 therebetween. The remainder of sleeve member 60 comprises a flared outlet 60B, and a flange 60C which is axially spaced from an annular plate member 68 to form the inlet to passageway 66. The sleeve member 58 has a portion thereof 58A concentrically spaced about the nozzle 42 of the coal burner depicted in FIG. 2, and the nozzle 57 of the gas burner depicted in FIG. 5. The sleeve portion 58A cooperates with the related nozzle to form a second annular passageway 62 therebetween. A plurality of vanes 70 are disposed within the passageway 62 in surrounding relation to the related nozzle. The vanes 70 are equidistantly spaced and preferably interconnected through a linkage train, not shown, so as to be collectively and simultaneously adjustable. A plurality of equidistantly spaced register blades 72 and 74 are located at the respective inlet ends of passageways 62 and 66. The register blades 72 and 74 are adapted to pivot between open, closed and intermediate positions and are preferably interconnected through a linkage train, not shown, so as to be collectively and simultaneously adjustable.

Referring to FIG. 6, the burner assembly shown therein is equipped with a single air register which is comprised of a sleeve member 76 disposed within the plenum chamber 22 to discharge combustion air and recirculated combustion gas at the inlet to the primary furnace 12. The sleeve member 76 has a portion thereof 76A concentrically spaced about the nozzle 42 to form an annular passageway 78 therebetween. The remainder of sleeve member 76 comprises a flared outlet 76B, and a flange 76C which is axially spaced from an annular plate member 80 to form the inlet to passageway 78. A plurality of equidistantly spaced register blades 82 are located at the inlet end of passageway 78. The register blades 82 are adapted to pivot between open, closed and intermediate positions and are preferably interconnected through a linkage train, not shown, so as to be collectively and simultaneously adjustable.

Figure 8:
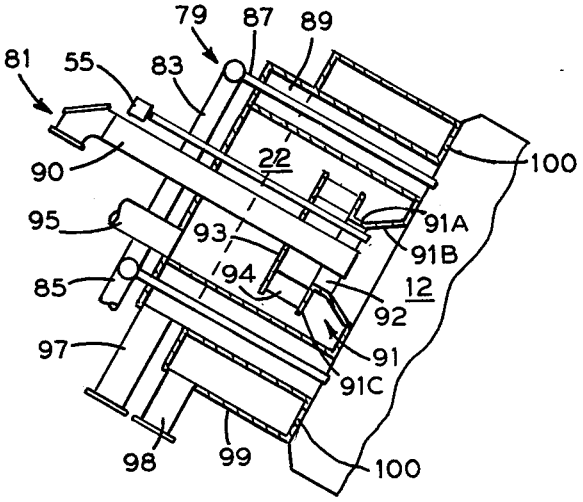
FIG. 8 is an alternate embodiment of FIG. 7 including a separate introduction of recirculated combustion gas to the primary furnace.
Figure 7:
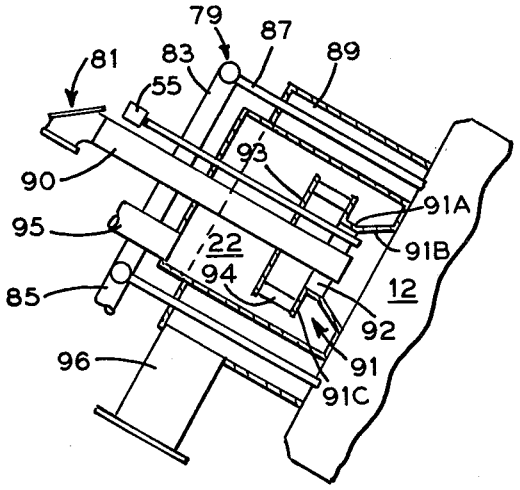
FIG. 7 is a partial view of the primary furnace associated with main and pilot burners adapted to fire coal.

Referring to FIGS. 7 and 8, there is shown a primary furnace 12 equipped with a pulverized coal burner 79 and a pulverized coal-fired pilot burner 81. The coal burner 79 includes a ring-shaped inlet manifold 83 that receives pulverized coal from a supply pipe 85 and is fitted with a plurality of nozzles 87 which extend through an annular duct 89 to discharge coal into the primary furnace 12. The pilot burner 81 includes a nozzle 90 centrally disposed within the plenum chamber 22 and discharging to the primary furnace 12. The pilot burner 81 is shown here as equipped with a single air register, however, it is equally adaptable to a dual air register. The single air register comprises a sleeve member 91 which has a portion thereof 91A concentrically spaced about the nozzle 90 to form an annular passageway 92 therebetween. The remainder of sleeve member 91 comprises a flared outlet 91B, and a flange 91C which is axially spaced from an annular plate member 93 to form the inlet to the passageway 92. A plurality of equidistantly spaced register blades 94 are located at the inlet end of passageway 92. The register blades 94 are adapted to pivot between open, closed and intermediate positions and are preferably interconnected through a linkage train, not shown, so as to be collectively and simultaneously adjustable. A supply duct 95 delivers combustion air to the plenum chamber 22 for discharge through the register to the primary furnace 12. Lighting of the coal is effectuated with the ingition device 55.

Referring to FIG. 7, there is shown a common duct 96 connected to the annular duct 89 and supplying combustion air and recirculated combustion gas thereto for discharge to the primary furnace 12.

Referring to FIG. 8, there is shown a duct 97 connected to the annular duct 89 and supplying combustion air thereto for discharge to the primary furnace 12, and a duct 98 supplying combustion gas to an annular duct 99 for discharge to the primary furnace 12 through a plurality of circularly spaced openings 100.

Referring to FIGS. 2, 3, 4, and 9, there is shown the inlet header 32 which supplies fluid to the tubes 30 lining the primary furnace 12, and the outlet header 34 which receives the fluid discharging from the tubes 30. A duct 84 delivers combustion air directly to the secondary furnace 14 through an outlet 86 disposed in surrounding relation to the outlet 20 of the primary furnace 12. The combustion air duct outlet 86 houses a plurality of damper blades 88 which are adapted to pivot between open, closed, and intermediate positions and are preferably interconnected through a linkage train, not shown, so as to be collectively and simultaneously adjustable.

Referring to FIGS. 4 and 9, there is shown alternate embodiments of the invention wherein the primary furnace of FIG. 4 is of generally circular cross-sectional flow area, and the primary furnace of FIG. 9 is of generally rectangular cross-sectional flow area.

During operation of the invention, the combustion air delivered to the primary furnace 12 is regulated to maintain 50 to 70 percent of total stoichiometric air to the primary furnace, and the remainder of the combustion air comprising 50 to 70 percent of total stoichiometric air is delivered to the secondary furnace 14. Whenever required, recirculated combustion gas may be delivered to the primary furnace 12 to maintain the maximum combustion temperatures in the primary and secondary furnaces at or below 2500° F. and 2900° F., respectively. The combustion gas delivered to the primary furnace is regulated to equal 10 to 30 percent of the total weight flow of combustion air supplied to both the primary and secondary furnaces.

In the embodiments shown at FIGS. 2 and 5, the combustion air supplied to the primary furnace 12 by the duct 54 is separated into first and second streams, with the first stream flowing through passageway 66 and the second stream through passageway 62. The streams are individually regulated by register blades 72 and 74 so that the first stream will comprise 60 to 70 percent of the combustion air being supplied by duct 54, with the remainder going to the second stream. It should be understood that whenever combustion gas is supplied by duct 54, the distribution of combustion gas as first and second streams will be the same as that of the combustion air. The vanes 70 are adjustable to impart a rotational component to the combustion air and gas flowing through the passageway 62.

In the embodiments shown at FIGS. 2 and 6, the combustion air used to convey pulverized coal to the burner 36 comprises 15 to 30 percent of total stoichiometric air. The remainder of the combustion air intended for the primary furnace 12 is supplied by duct 54 and delivered through passageways 62 and 66 for the embodiment of FIG. 2, and passageway 78 for the embodiment of FIG. 6.

In the embodiments shown in FIGS. 7 and 8, 12 to 20 percent of the pulverized coal is fired through the pilot burner 81 and the remainder is fired through the main burner 79. The following percentage distributions of combustion air delivered to the primary furnace is based on total stoichiometric air: 2 to 8 percent used to convey pulverized coal to the pilot burner 81; 4 to 12 percent supplied by duct 95 through the plenum 22 and passageway 92 as combustion air for the pilot burner 91; 13 to 22 percent used to convey pulverized coal through inlet 85 to the main burner 79; and 20 to 40 percent supplied by duct 96 through the annular duct 89 as combustion air for the main burner 79. Combustion gas, whenever required, is introduced by duct 96 and is regulated to equal 10 to 30 percent of the total weight flow of combustion air supplied to both the primary and secondary furnaces.

In the embodiment shown at FIG. 8, the combustion air for the main burner 79 is supplied by duct 97 and the combustion gas, whenever required, is supplied by duct 98 through the annular duct 89 for discharge through openings 100.

While in accordance with the provisions of the statutes there is illustrated and described herein a specific embodiment of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A method for inhibiting the formation of nitric oxides when burning pulverized coal, and including at least one primary furnace having inlet and outlet openings, a secondary furnace in receiving communication with the outlet opening, and comprising the steps of:
   - introducing combustion air and pulverized coal through the primary furnace inlet opening,
   - regulating the combustion air to introduce 50 to 70 percent of total stoichiometric air to the primary furnace, said combustion air including air for conveying the pulverized coal to the primary furnace,
   - maintaining the coal-conveying air at 15 to 30 percent of total stoichiometric air,
   - introducing combustion air to the secondary furnace,
   - regulating the last named combustion air to introduce 50 to 70 percent of total stoichiometric air to the secondary furnace, and
   - controlling the first and second named regulating steps to maintain the total quantity of combustion air supplied to said primary and secondary furnaces in the range of 105 to 125 percent of total stoichiometric air.

2. The method according to claim 1 including the step of providing first and second burner means communicating with the inlet opening for introducing the air-conveyed coal to the primary furnace.

3. The method according to claim 2 including the step of maintaining the coal-conveying air to the first burner means at 2 to 8 percent of total stoichiometric air.

4. The method according to claim 2 including the step of introducing 4 to 12 percent of total stoichiometric air around the outlet of said first burner means.

5. The method according to claim 2 including the step of maintaining the coal-conveying air to the second burner means at 13 to 22 percent of total stoichiometric air.

6. The method according to claim 2 including the step of introducing 20 to 40 percent of total stoichiometric air around the outlet of said second burner means.

7. An apparatus for inhibiting the formation of nitric oxides when burning fuel, and comprising a plurality of primary furnaces having respective inlet and outlet openings, a secondary furnace in receiving communication with the outlet openings, the primary and secondary furnaces being lined with fluid cooled tubes, means for introducing fuel and combustion air through the respective primary furnace inlet openings, means for regulating the combustion air to introduce 50 to 70 percent of total stoichiometric air to the primary furnaces, means for introducing combustion air to the secondary furnace, means for regulating the last named combustion air to introduce 50 to 70 percent of total stoichiometric air to the secondary furnace, the first and second named regulating means being controlled to maintain the total quantity of combustion air supplied to said primary and secondary furnaces in the range of 105 to 125 percent of total stoichiometric air.

* * * * *